US008209895B2

(12) United States Patent
Dueck et al.

(10) Patent No.: US 8,209,895 B2
(45) **Date of Patent: *Jul. 3, 2012**

(54) SYSTEMS FOR ATTACHING A NOISE SUPPRESSOR TO A FIREARM

(75) Inventors: Barry W. Dueck, Sunset Beach, CA (US); John W. Matthews, Newport Beach, CA (US); Brook C. Smith, Costa Mesa, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/102,819

(22) Filed: May 6, 2011

(65) Prior Publication Data

US 2011/0203152 A1 Aug. 25, 2011

Related U.S. Application Data

(63) Continuation of application No. 12/582,958, filed on Oct. 21, 2009, now Pat. No. 7,946,069, which is a continuation of application No. 11/171,178, filed on Jun. 29, 2005, now Pat. No. 7,676,976, which is a continuation-in-part of application No. 10/703,971, filed on Nov. 6, 2003, now Pat. No. 6,948,415.

(51) Int. Cl.
*F41A 21/00* (2006.01)

(52) U.S. Cl. ..... 42/90; 42/1.06; 89/14.4; 89/14.3; 89/14.2

(58) Field of Classification Search ..... 42/90, 1.06, 42/85, 146; 89/14.2–14.6
See application file for complete search history.

(56) References Cited

U.S. PATENT DOCUMENTS

| | | | |
|---|---|---|---|
| 1,054,434 | A | 2/1913 | Maxim |
| 1,143,814 | A | 6/1915 | De Vries |
| 1,354,416 | A | 9/1920 | Oliver |
| 1,872,048 | A | 8/1932 | Thomas, Jr. |
| 2,712,193 | A | 7/1955 | Mathis |
| 2,807,112 | A | 9/1957 | Garand |
| 2,953,972 | A | 9/1960 | Sorensen |
| 3,075,792 | A | 1/1963 | Franck |
| 3,385,613 | A | 5/1968 | McCall |
| 3,698,747 | A | 10/1972 | Wing et al. |
| 4,429,614 | A | 2/1984 | Tocco |
| 5,092,223 | A | 3/1992 | Hudson |
| 5,356,183 | A | 10/1994 | Cole |

(Continued)

FOREIGN PATENT DOCUMENTS

GB 2 242 476 A 10/1991

OTHER PUBLICATIONS

Gemtech Division of Gemini Technologies, Inc., HALO Centerfire Rifle Suppressors, 3 internet web pages, copyright 2005 (webpages accessed Jun. 28, 2005).

(Continued)

*Primary Examiner* — J. Woodrow Eldred
(74) *Attorney, Agent, or Firm* — Haynes and Boone, LLP

(57) ABSTRACT

Apparatus and methods for easily, quickly and reliably longitudinally securing and rotationally locking a noise suppressor or other auxiliary device to the muzzle end of a firearm barrel, and to a fixture such as a flash suppressor affixed to the muzzle end of the firearm, and for easily, quickly and reliably removing the noise suppressor or other auxiliary device therefrom.

27 Claims, 5 Drawing Sheets

U.S. PATENT DOCUMENTS

| | | | |
|---|---|---|---|
| 5,433,133 | A | 7/1995 | LaFrance |
| 5,559,302 | A | 9/1996 | Latka |
| 5,773,746 | A | 6/1998 | Vaden |
| 6,216,578 | B1 | 4/2001 | Ledys et al. |
| 6,276,251 | B1 | 8/2001 | Downing et al. |
| 6,385,891 | B1 | 5/2002 | Rabatin |
| 6,412,389 | B2 | 7/2002 | Fluhr |
| 6,450,079 | B1 | 9/2002 | Bourdin et al. |
| 6,516,698 | B1 | 2/2003 | Poff, Jr. |
| 6,948,415 | B2 | 9/2005 | Matthews et al. |
| 7,588,122 | B2 | 9/2009 | Brittingham |
| 7,676,976 | B2 | 3/2010 | Dueck et al. |
| 8,030,603 | B2 | 10/2011 | Schroeder |
| 2010/0199834 | A1 | 8/2010 | Dueck et al. |

OTHER PUBLICATIONS

Remington Arms Company, Inc., M24 Sniper Weapon Sysyem, 3 internet web pages, copyright 2004 (webpages accessed Jun. 28, 2005).

Brugger & Thomet AG (Switzerland), unpublished drawing No. SD-988201, drawn May 7, 2002.

SYSTEMS FOR ATTACHING A NOISE SUPPRESSOR TO A FIREARM

RELATED APPLICATIONS

This application is a continuation of U.S. patent application Ser. No. 12/582,958, filed Oct. 21, 2009, now U.S. Pat. No. 7,946,069, which is a continuation of U.S. patent application Ser. No. 11/171,178, filed Jun. 29, 2005, now U.S. Pat. No. 7,676,976, which is a continuation-in-part of U.S. patent application Ser. No. 10/703,971, filed Nov. 6, 2003, now U.S. Pat. No. 6,948,415, all of which are incorporated herein by reference in their entirety.

BACKGROUND OF THE DISCLOSURE

This invention relates to firearms, and more particularly to systems for removably attaching a noise suppressor or other auxiliary device to the muzzle of a firearm barrel.

Various systems are known in the firearms art for attaching a noise suppressor to a firearm, and specifically for removably attaching a noise suppressor to a flash suppressor affixed to the muzzle end of a firearm. There nevertheless exists a need for improving such systems, particularly for increasing the ease by which a user may attach a noise suppressor to a flash suppressor or directly to the firearm barrel while at the same time effecting a reliable securement therebetween capable of withstanding the vibrations incidental to the firing of such firearms as automatic rifles used by military personnel, and without adversely affecting accuracy or consistency of high precision firearms.

SUMMARY OF THE DISCLOSURE

The present invention provides an apparatus and method for easily, quickly and reliably attaching a noise suppressor or other auxiliary device to the muzzle end of a firearm barrel, and for easily and quickly removing such device therefrom. In a preferred embodiment of the invention, a noise suppressor is removably secured to a fixture such as a flash suppressor secured to the muzzle end of a firearm.

In general terms, the invention provides auxiliary apparatus for attachment to a firearm including a barrel having a longitudinal axis, comprising the combination of: a fixture adapted to be attached to the muzzle of the barrel coaxially therewith and including an annular ridge; and an auxiliary device having a bore for coaxially receiving the fixture, such device including a collar having an outer surface eccentric about the bore, and a ring having an annular wall rotatably secured to the outer surface of the collar, the ring including a radial wall having a circular opening eccentric relative to the annular wall, the opening being concentric relative to the bore at a first rotational position of the ring for permitting the ring to pass over the ridge, the opening being eccentric relative to the bore at a second rotational position of the ring for causing the radial wall to block passage of the ring over the ridge.

More specifically, a preferred embodiment according to the invention provides a noise suppressor apparatus for attachment to a firearm including a barrel having a longitudinal axis, comprising the combination of: a flash suppressor adapted to be attached to the muzzle of the barrel coaxially therewith and including an annular ridge; and a noise suppressor including a back section having a bore for coaxially receiving the flash suppressor, the back section including a collar having an outer surface eccentric about the bore, and a ring having an annular wall rotatably secured to the outer surface of the collar, the ring including a radial wall having a circular opening eccentric relative to the annular wall, the opening being concentric relative to the bore at a first rotational position of the ring for permitting the ring to pass over the ridge, the opening being eccentric relative to the bore at a second rotational position of the ring for causing the radial wall to block passage of the ring over the ridge.

The collar preferably includes an edge about the bore engaging the ridge when the flash suppressor is received by the bore, and the ring is longitudinally translatable on the collar for urging the radial wall to engage the ridge when the flash suppressor is received by the bore. In the preferred embodiment, the annular wall of the ring is threadedly secured to the outer surface of the collar. The noise suppressor may be circumferentially indexed to the flash suppressor; for example, the noise suppressor's back section may include a radial pin for being received by a longitudinal groove in the flash suppressor, such as a notch in the forward edge of the flash suppressor.

The aforementioned parent application Ser. No. 10/703,971 discloses a preferred embodiment of the noise suppressor apparatus including a locking device associated with the ring and with the noise suppressor's back section for releasably locking the ring in its second rotational position, as well as for releasably retaining the ring in its first rotational position. The locking device may include a locking bar affixed to the back section and having a pawl, and ratchet teeth on the ring engaging the pawl when the ring is in its second rotational position for locking the ring in that position. A manually operable actuator on the locking bar releases the pawl from engagement with the ratchet teeth so that the ring may be placed in its first rotational position when it is desired to remove the noise suppressor from the flash suppressor.

The locking bar may further include a second pawl for cooperating with the ratchet teeth when the ring is in its first rotational position, for releasably retaining the ring in that position. The apparatus preferably further includes a stop on the noise suppressor's back section, the stop cooperating with the ring for restricting rotation of the ring between its first rotational or open position and its second rotational or lock position.

According to another aspect of the invention, a method is provided of attaching an auxiliary device to the barrel of a firearm having a longitudinal axis, comprising: providing an annular ridge on a forward portion of the barrel; providing a noise suppressor including a bore and a collar having a threaded outer surface eccentric about the bore, the ring having an annular wall threaded onto the outer surface of the collar, the ring including a radial wall having a circular opening eccentric relative to the annular wall; rotating the ring on the collar until the opening is concentric relative to the bore at a first rotational position of the ring for permitting the ring to pass over the ridge; placing the auxiliary device to the firearm with the barrel's forward portion received by the bore; and threading the ring on the collar until the opening is eccentric relative to the bore at a second rotational position for causing the radial wall to block passage of the ring over the ridge. The auxiliary device may be removed from the firearm barrel by unthreading the ring on the collar until the ring is at its first rotational position; and longitudinally withdrawing the auxiliary device from the forward portion of the barrel.

In a preferred embodiment of the method, the annular ridge is provided on the barrel by providing a flash suppressor with an annular ridge and by coaxially affixing the flash suppressor to the muzzle of the barrel, and the auxiliary device comprises a noise suppressor.

A second preferred embodiment of the auxiliary apparatus (such as the noise suppressor apparatus) of the invention includes a locking device associated with the retainer ring and with the fixture (such as the flash suppressor), for releasably locking the retainer ring in the second rotational position. Such locking device preferably includes ratchet teeth on the flash suppressor, and a pawl on the ring engaging the ratchet teeth when the ring is in its second rotational position for locking the ring in that position. The ring preferably includes a manually operable actuator for releasing the pawl from its engagement with the ratchet teeth.

In general terms, an aspect of the present invention provides auxiliary apparatus for attachment to a firearm including a barrel having a longitudinal axis, comprising the combination of: a fixture adapted to be attached to the muzzle of the barrel coaxially therewith; an auxiliary device including a body having a bore for coaxially receiving the fixture and a rotatable retainer member engaging the body, the retainer member and the fixture adapted for cooperative engagement when the fixture is received by the bore, the retainer member having a first rotational position permitting the fixture to be longitudinally received by the bore and a second rotational position longitudinally securing the auxiliary device to the fixture when received by the bore; and a locking device for releasably locking the retainer member in the second rotational position. The locking device may be associated with the retainer member and the fixture in accordance with the second preferred locking device embodiment. Alternatively, the locking device may be associated with the retainer member and the body of the auxiliary device, in accordance with the first preferred locking device embodiment.

Another aspect of the present invention provides an auxiliary apparatus (such as a noise suppressor apparatus) for attachment to a firearm including a barrel having a longitudinal axis, comprising the combination of: a fixture adapted to be attached to the muzzle of the barrel coaxially therewith; an auxiliary device (such as a noise suppressor) including a body having a bore for coaxially receiving the fixture and a retainer member threadedly engaging the body and adapted for longitudinally securing the body to the fixture when the fixture is received by the bore and the retainer member is threaded onto the body; and a locking device for releasably locking the retainer member from unthreading from the body when the body is longitudinally secured to the fixture. The locking device may include either of the first or second locking device preferred embodiments described above.

According to a further aspect of the present disclosure, there is provided firearm apparatus comprising the combination of: a firearm including a barrel having a muzzle portion and a longitudinal axis; an auxiliary device (such as a noise suppressor) including a body having a bore for coaxially receiving the muzzle portion, the auxiliary device including a retainer member rotatably secured to the body, the retainer member and the barrel adapted for cooperative engagement when the muzzle portion is received by the bore, the retainer member having a first rotational position permitting the muzzle portion to be longitudinally received by the bore and a second rotational position longitudinally securing the auxiliary device to the muzzle portion when received by the bore; and a locking device for releasably locking the retainer member in the second rotational position. The firearm barrel preferably includes an annular ridge, and the retainer member is adapted for cooperatively engaging the ridge when the firearm's muzzle portion is received by the bore.

The locking device may be associated with the retainer member and the barrel. For example, the locking device may include ratchet teeth on the barrel, and a pawl on the retainer member engaging the ratchet teeth when the retainer member is in its second rotational position. Such locking device may include a manually operable actuator on the retainer member adapted to unlock the retainer member from the second rotational position when actuated.

The locking device may alternatively be associated with the retainer member and with the auxiliary device body. The locking device may include a locking bar affixed to the body and having a pawl, and may further include ratchet teeth on the retainer member engaging the pawl when the retainer member is in its second rotational position for locking the retainer member in that position. The locking bar preferably includes a manually operated actuator for releasing the pawl from its engagement with the ratchet teeth.

A further aspect of the present invention includes a method for attaching an auxiliary device to a barrel of a firearm having a longitudinal axis, comprising: providing the barrel; machining the barrel to provide an annular ridge thereon; providing an auxiliary device (such as a noise suppressor) including a body having a longitudinal bore and a rotatable retainer member threadedly securable to the body; placing the auxiliary device to the barrel with a forward portion of the barrel received by the bore and with the ridge disposed in the retainer member; threadedly rotating the retainer member on the body until the body is longitudinally secured to the barrel; and locking the retainer member against unthreading rotation from the body. During the machining step, a longitudinal groove may be machined in the barrel's forward portion; and during the placing step, the body cooperates with the longitudinal groove for preventing rotation of the body with respect to the barrel.

The locking step may be implemented by interaction between the retainer member and the barrel. For example, during the machining step, ratchet teeth are machined circumferentially along the barrel's forward portion, preferably along the ridge; and during the locking step, a pawl carried by the retainer member cooperates with the ratchet teeth for locking the retainer member against unthreading rotation from the body.

Alternatively, the locking step may be implemented by interaction between the retainer member and the body. For example, during the auxiliary device providing step, the body may include a locking bar affixed thereto and having a pawl, and the retainer member may include ratchet teeth cooperating with the pawl.

BRIEF DESCRIPTION OF THE DRAWINGS

The novel features believed to be characteristic of the present invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
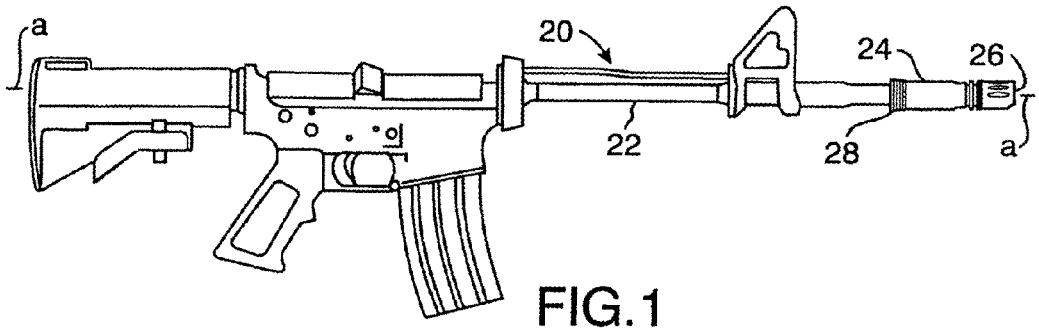
FIG. 1 is a side view of a firearm equipped with a flash suppressor including features of a preferred embodiment of the present invention.
Figure 2:
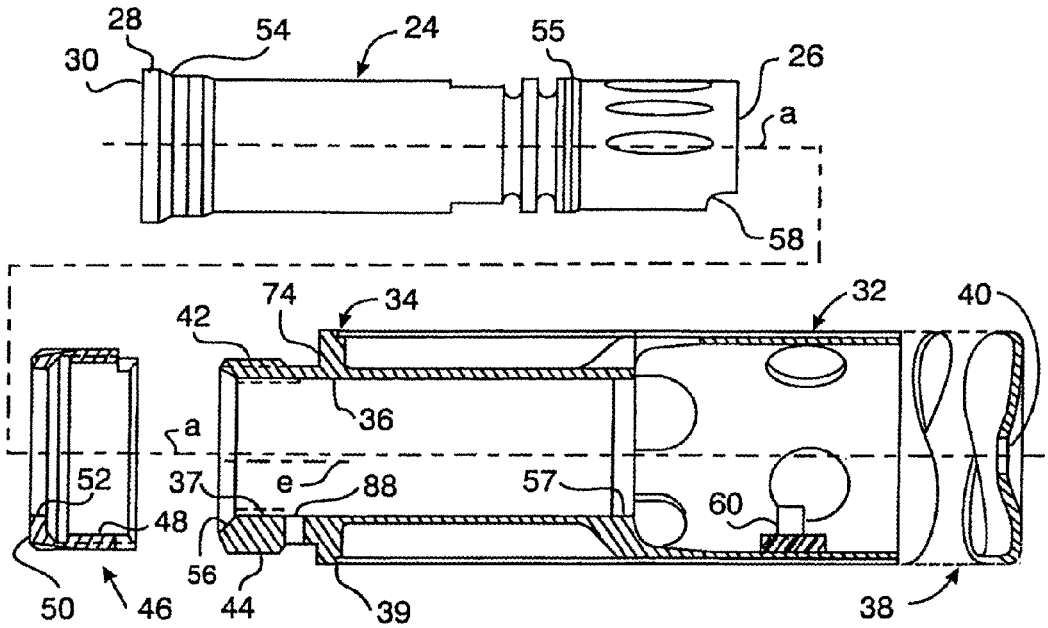
FIG. 2 is an exploded side view of components of a preferred embodiment of apparatus for attaching a noise suppressor to a firearm, shown partially in cross-section and partially fragmented.
Figure 3:
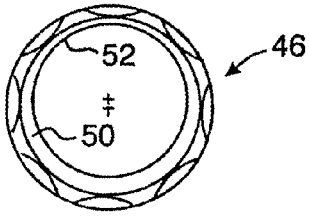
FIG. 3 is a rear view of the retainer ring component shown in FIG. 2.
Figure 10:
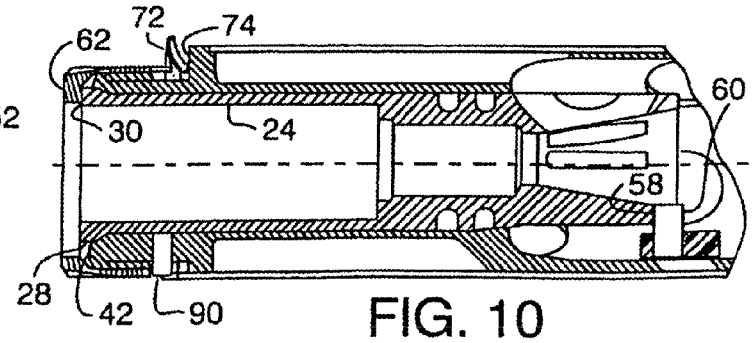
FIG. 10 is a cross-sectional view of a fragment of the noise suppressor back section with locking retainer ring of FIG. 7, taken along the line 10-10 of FIG. 7 and viewed in the direction of the appended arrows.

Turning first to FIGS. 1-6, there is illustrated in FIG. 1 an example of a firearm 20, such as an M-4 or M-16 automatic rifle, to which a firearm accessory, in particular a noise suppressor according to the present invention, may be removably secured. The firearm 20 includes a barrel 22 having a longitudinal axis a along which a fired bullet is caused to travel. A generally tubular fixture 24—such as a flash suppressor, muzzle brake or muzzle compensator—is secured to the barrel's muzzle along the longitudinal axis a, the tubular fixture 24 having a forward opening 26 through which the fired bullet exits. The tubular fixture 24 shown in the drawings of FIGS. 1, 2 and 10 is a flash suppressor 24 which is fixedly secured to the firearm barrel 22 such as by welding or other conventional securement means (for example, by means of mating threads externally about the barrel muzzle and internally of the flash suppressor together with a high temperature cement or a locking device for preventing rotation of the installed flash suppressor 24 with respect to the firearm barrel 22). In the drawings other than FIG. 1, the firearm barrel 22, to which the flash suppressor 24 is secured, is not shown for purposes of clarity of description.

In the preferred embodiment according to the present invention, the flash suppressor 24 is provided with an external annular ridge 28 preferably along the flash suppressor's annular rear end 30, although the annular ridge 28 may be included as a part of the exterior surface of the firearm barrel 22.

As used herein, the word "front" or "forward" corresponds to the firing direction of the firearm 20 (i.e., to the right as shown in FIGS. 1, 2, 7, 10, 13, 18 and 21-25); "rear" or "rearward" or "back" corresponds to the direction opposite the firing direction of the firearm 20 (i.e., to the left as shown in FIGS. 1, 2, 7, 10, 13, 18 and 21-25); and "longitudinal" means the direction along or parallel to the longitudinal axis a of the firearm barrel 22 or 120 or of the flash suppressor 24 or 24', or of the noise suppressor body 32.

The noise suppressor body 32 includes a back section 34 having a longitudinal bore 36 for coaxially receiving the flash suppressor 24. The noise suppressor body 32 further includes a sound suppressing front section 38 fixedly secured to the back section 34 (for example by welding along their circumferences as at 39) including a front end having an axial opening 40 through which a fired bullet exits when the noise suppressor body 32 is secured to the firearm barrel 22. Noise suppressing sections of firearm noise suppressors are well known in the firearms art.

Figure 4:
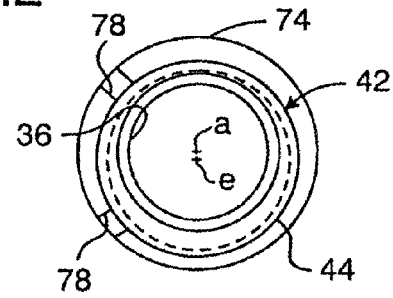
FIG. 4 is a rear view of the noise suppressor back section shown in FIG. 2.

The back section 34 of the noise suppressor body 32 as shown in FIG. 2 includes a rear collar 42 having an inner surface 37 along the longitudinal bore 36 and an threaded outer surface 44 which is eccentric about the longitudinal bore 36, i.e. the threaded outer surface 44 of the rear collar 42 is centered about an axis e parallel to and spaced from the longitudinal axis a (see FIGS. 2 and 4).

A retainer ring 46 having an internally threaded annular wall 48 is threadedly secured to the externally threaded outer surface 44 of the rear collar 42. The retainer ring 46 includes a transverse or radial wall 50 having a circular opening 52 eccentric relative to the threaded annular wall 48. When the retainer ring 46 is threaded upon the eccentric threaded outer surface 44 of the rear collar 42, the circular opening 52 is concentric relative to the longitudinal bore 36 at a first rotational position of the retainer ring 46 relative to the threaded outer surface 44 of the collar 42, and the circular opening 52 is eccentric relative to the longitudinal bore 36 at a second rotational position of the retainer ring 46 relative to the threaded outer surface 44 of the collar 42. In the preferred embodiment, the rotation of the retainer ring 46 between its first and second rotational positions is about one-half revolution or approximately 180°.

When installing the noise suppressor 31 onto the firearm barrel 22, the engagement of the retainer ring 46 onto the collar 42 is such that the retainer ring 46 is at its first rotational position wherein the circular opening 52 is concentric relative to the longitudinal bore 36. The diameter of the longitudinal bore 36 is slightly greater than the outside diameter of the tubular flash suppressor 24 but is slightly less than the diameter of the annular ridge 28 on the flash suppressor 24, and the diameter of the circular opening 52 through the rear radial wall 50 of the retainer ring 46 is slightly greater than the diameter of the annular ridge 28. In one example, the flash suppressor 24 had a tubular outside diameter of approximately 0.864 inch and a ridge diameter of approximately 0.987 inch; the longitudinal bore 36 of the back section 34 had a diameter of approximately 0.906 inch, and the threaded outer surface 44 of the collar 42 had a diameter of approximately 1.25 inch about center axis e spaced from the longitudinal axis a by approximately 0.050 inch; and the retainer ring 46 had a circular opening 52 of diameter approximately 1.020 inch with a center spaced approximately 0.050 inch from the center of the ring's threaded annular wall 48.

To install the noise suppressor (comprising the noise suppressor body 32 and the retainer ring 46) onto the firearm barrel 22, the noise suppressor body 32 with the retainer ring 46 secured to the threaded outer surface 44 in the first rotational position as described above, is placed rearwardly onto the barrel's muzzle end such that the flash suppressor 24 is longitudinally received by the back section longitudinal bore 36 through the circular opening 52, until the front edge 54 of the annular ridge 28 engages the rear edge 56 of the collar 42 about the longitudinal bore 36, and with an annular external surface 55 toward the forward end portion of the flash suppressor 24 engaging an annular internal surface 57 of the noise suppressor back section 34. The front and rear edges 54, 56 may be configured with complementary bevels for implementing mating contact thereof. At the same time, the noise suppressor is rotationally adjusted with respect to the firearm barrel 22 for circumferentially indexing the noise suppressor body 32 to the firearm barrel 22 and for preventing rotation of the noise suppressor body 32 with respect to the barrel, for example by means of a longitudinal channel, such as a forwardly facing notch 58 at the front edge of the flash suppressor 24, receiving a radially disposed indexing pin 60 internally secured to the noise suppressor back section 34, as shown in FIGS. 2 and 10.

Figure 5:
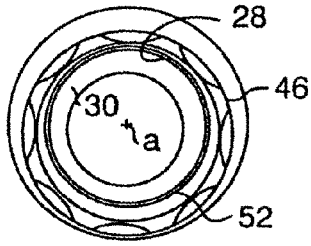
FIG. 5 is a rear view of the assembled components of FIG. 2 in an open condition permitting the noise suppressor to be installed to or removed from the flash suppressor.

At this point during installation, the circular opening 52 of the retainer ring 46, being concentric with the annular ridge 28 and having a diameter slightly greater than the diameter of the annular ridge 28, permits the retainer ring 46 to longitudinally pass over the flash suppressor's annular ridge 28 as shown in FIG. 5. After such passage, installation proceeds by threadedly rotating the retainer ring 46 upon the threaded outer surface 44 of the collar 42, with the resulting eccentric rotation of the circular opening 52 of the radial wall 50 to place a segment or portion 62 of that radial wall 50 directly rearward of a portion of the annular ridge 28 of the flash suppressor 24. At the same time, such threaded rotation causes the retainer ring 46 to forwardly translate such that the forward surface of the portion 62 of the radial wall 50 contacts that portion of the annular ridge 28 of the flash suppressor 24. Accordingly, the interfering portion 62 of the radial wall 50 blocks forward longitudinal passage of the retainer ring 46 over the annular ridge 28.

Figure 6:
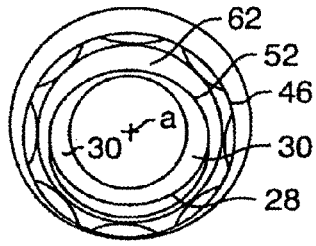
FIG. 6 is a view similar to FIG. 5, except that the apparatus is in a condition blocking removal of the noise suppressor from the flash suppressor.

Upon such installation, the noise suppressor is fixedly secured to the flash suppressor 24 (and hence to the firearm barrel 22) both longitudinally and rotationally. In the disclosed example of the preferred embodiment, the rotation from the open or unsecured configuration shown in FIG. 5 to the secured configuration shown in FIG. 6 is optimally approximately 180° or approximately one-half turn, although it may be appreciated that securing interference commences at substantially lesser rotation.

To remove the noise suppressor from the firearm barrel 22, the retainer ring 46 is rotated in the reverse or unthreading direction to its first rotational position as shown in FIG. 5, whereupon the circular opening 52 is concentric relative to the longitudinal bore 36, thereby permitting the retainer ring 46 to be passed over the annular ridge 28. The back section 34 with attached retainer ring 46 may thereupon be forwardly longitudinally withdrawn from the flash suppressor 24 and the firearm barrel 22 when the noise suppressor body 32 is moved longitudinally forwardly.

The apparatus according to the present invention preferably includes a locking device to lock the retainer ring 46 in its second rotational position with the forward surface of the blocking portion 62 of the radial wall 50 rearwardly engaging the annular ridge 28. An example of such locking device is shown in FIGS. 7-12.

The forwardly facing edge of the internally threaded annular wall 48 of the retainer ring 46 includes a longitudinally projecting segment 64 between a first end surface 66 and a second end surface 68. The segment 64 includes a series of ratchet teeth 70 adjacent to the first end surface 66. For example, the segment 64 may extend over an arc of say approximately 150° of which say approximately 35° includes the ratchet teeth 70.

Figure 9:
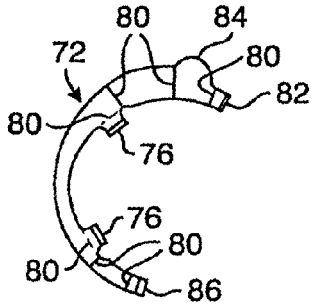
FIG. 9 is a plan view of a locking bar component of the locking device shown in FIG. 7.
Figure 12:
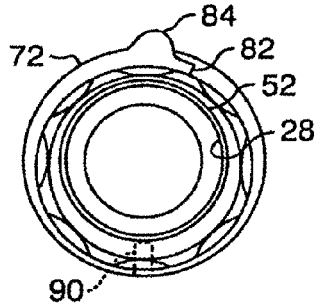
FIG. 12 is similar to FIG. 11, except that the assembled components are shown in the open condition.
Figure 11:
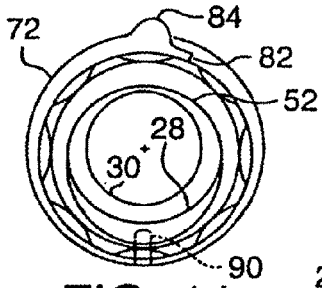
FIG. 11 is a rear view of the assembled components of FIG. 10, shown in the locked condition.

A locking bar 72 is affixed to the rear flange 74 of the noise suppressor body 32, such as by means of radially extending tabs 76 of the locking bar 72 snapped into radial channels 78 in the rearwardly facing surface of the rear flange 74 (see FIGS. 9 and 4). The locking bar 72 may be fabricated of a somewhat flexible plate such as steel and is bent along lines 80. A pawl 82 at one end of the locking bar 72 cooperates with the ratchet teeth 70 when the retainer ring 46 is in its second rotational position for locking the retainer ring 46 against unthreading rotation, thereby preventing undesired movement and removal of the noise suppressor 31 from the firearm barrel 22.

The locking bar 72 includes a manually operable actuator for unlocking the retainer ring 46, such as a radially extending pad 84 adjacent to the pawl 82, which radially extending pad 84 may be urged forwardly (for example by a user's thumb) for disengaging the pawl 82 from the ratchet teeth 70. A second pawl 86 at the other end of the locking bar 72 engages the ratchet teeth 70 when the retainer ring 46 is in its first rotational position, for releasably restraining rotation of the retainer ring 46 from its first position.

Figure 7:
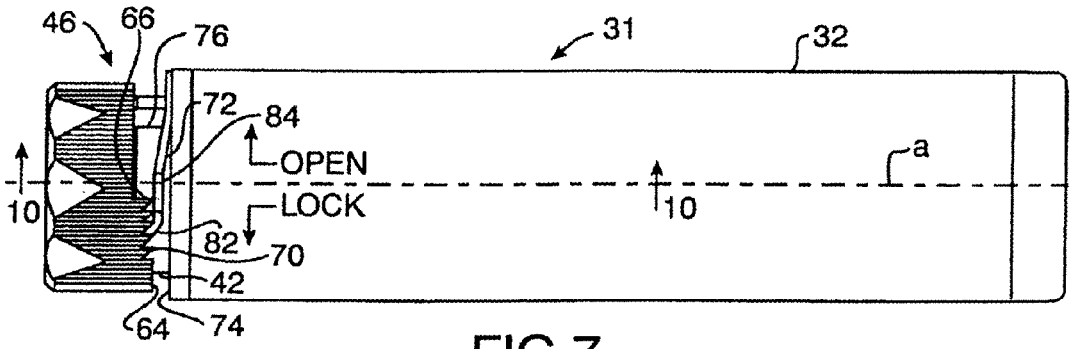
FIG. 7 is a top plan view of the assembled components of FIG. 2, including a locking device.
Figure 8:
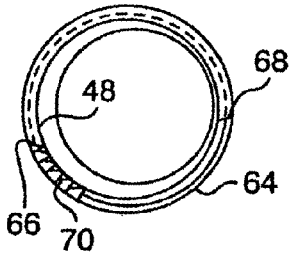
FIG. 8 is a front view of the locking retainer ring shown in FIG. 7.

When installing the locking retainer ring 46 to the collar 42, the retainer ring 46 is threadedly rotated upon the threaded collar 42 (in the clockwise direction as viewed from the rear, i.e. from the left side of FIG. 7) until the first end surface 66 passes over a radial bore 88 in the collar 42 (see FIG. 2) preferably at a circumferential position approximately along a radius intersecting the point of the maximum distance of the collar's threaded outer surface 44 from the longitudinal axis a. A projecting stop pin 90 is then fixedly secured into the radial bore 88, the projecting stop pin 90 radially projecting from the threaded outer surface 44 for stopping clockwise (threading) rotation of the retainer ring 46 when the ring's second end surface 68 contacts the projecting stop pin 90

(preferably while the ring is still in its second rotational position), and for stopping counterclockwise (unthreading) rotation of the retainer ring 46 when its first end surface 66 contacts the projecting stop pin 90 (preferably at the ring's first position). The projecting stop pin 90, situated between the ring's first and second end surfaces 66, 68 as described, causes the retainer ring 46 to be rotationally captive to the collar 42 between the ring's first or "open" position (shown in FIG. 12) and the ring's second or "lock" position (shown in FIGS. 10 and 11).

When installing the noise suppressor 31 (with locking device) to the firearm barrel 22, the retainer ring 46—which is preferably maintained in its "open" position with the second pawl 86 engaging one of the ratchet teeth 70—is placed rearwardly onto the barrel's muzzle end such that the flash suppressor 24 is longitudinally received by the back section longitudinal bore 36 as previously described. The user then urges the retainer ring 46 to threadedly rotate upon the threaded outer surface 44 of the collar 42, releasing the second pawl 86 from its engagement with the ratchet teeth 70 and placing the retainer ring 46 is in its second rotational position whereby a portion 62 of the ring's radial wall 50 rearwardly contacts a portion of the annular ridge 28 of the flash suppressor 24. Such rotation also places the ratchet teeth 70 in operative engagement with the pawl 82, thereby locking the retainer ring 46 against unthreading rotation, effectively locking the noise suppressor 31 to the flash suppressor 24 and the firearm barrel 22.

When it is desired to remove the noise suppressor 31 from the flash suppressor 24 and the firearm barrel 22, the user unthreadedly rotates the retainer ring 46 while urging the radially extending pad 84 forwardly to release the pawl 82 from the ratchet teeth 70. The user continues unthreadedly rotating the retainer ring 46 until the ring's first end surface 66 contacts the projecting stop pin 90, whereupon the locking bar's second pawl 86 engages one of the ratchet teeth 70, thereby placing and maintaining the retainer ring 46 in its first or open position shown in FIG. 12. The user thereupon longitudinally withdraws the noise suppressor 31 from the flash suppressor 24 and the firearm barrel 22.

The second preferred locking mechanism embodiment of the present invention is shown in FIGS. 13-20 and described below as implemented by a second preferred embodiment of the retainer ring 46' in combination with a second preferred embodiment of the flash suppressor 24'.

Figure 13:
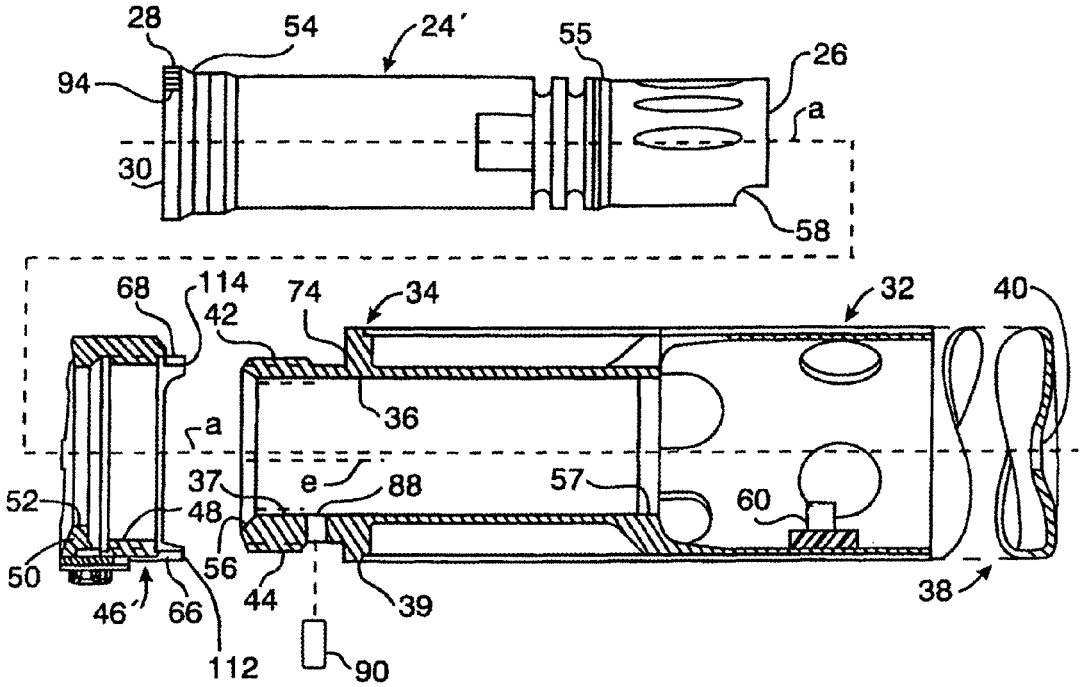
FIG. 13 is an exploded side view of components of a second preferred embodiment of apparatus for attaching a noise suppressor to a firearm, shown partially in cross-section and partially fragmented, the second preferred embodiment being similar to the embodiment shown in FIG. 2 but with a second locking mechanism embodiment.

The noise suppressor body 32 shown in FIG. 13 is similar to the noise suppressor body 32 shown in FIG. 2 and described above, including the rear collar 42 having an inner surface 37 along the longitudinal bore 36 and an threaded outer surface 44 which is eccentric about the longitudinal bore 36, i.e. the threaded outer surface 44 of the collar 42 is centered about the axis e parallel to and spaced from the longitudinal axis a.

The second preferred embodiment of the retainer ring 46', like the first preferred retainer ring embodiment 46 shown in FIGS. 2, 3, 5 and 6, includes an internally threaded annular wall 48 threadably securable to the externally threaded outer surface 44 of the collar 42, as well as a generally radial wall 50 having a circular opening 52 eccentric relative to the threaded annular wall 48. When the retainer ring 46' is threaded upon the eccentric threaded outer surface 44 of the collar 42, the circular opening 52 is concentric relative to the longitudinal bore 36 at a first rotational position of the ring 46' relative to the threaded outer surface 44 of the collar 42, and the circular opening 52 is eccentric relative to the longitudinal bore 36 at a second rotational position of the retainer ring 46' relative to the threaded outer surface 44 of the collar 42. Similarly to the first preferred embodiment, the rotation of the retainer ring 46' between its first and second rotational positions is about one-half revolution or approximately 180°.

Figure 14:
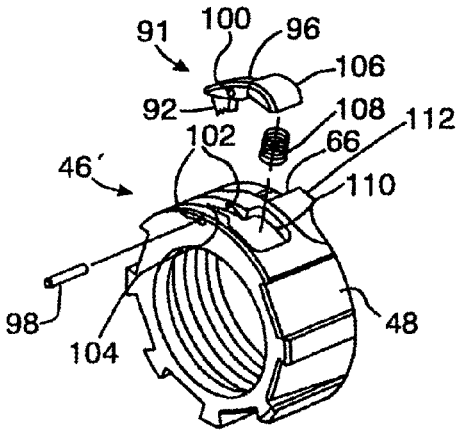
FIG. 14 is an exploded perspective view of the retainer ring of the second preferred embodiment shown in FIG. 13.
Figure 15:
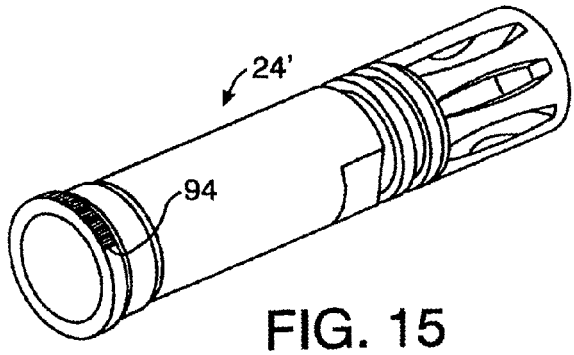
FIG. 15 is a perspective view of the flash suppressor shown in FIG. 13, which flash suppressor is similar to the flash suppressor shown in FIG. 2 but modified for cooperating with the retainer ring of FIG. 14 for releasably locking the retainer ring against rotational movement with respect to the noise suppressor of FIG. 13.

An example of a second preferred locking device embodiment of the present invention is implemented by a locking lever mechanism 91 including a generally radially biased pawl 92 carried by the second retainer ring embodiment 46', in cooperation with a series of generally radial ratchet teeth 94 spaced along a circumference or a circumferential segment of the flash suppressor 24' such as along the outer surface of the annular ridge 28, as best shown in FIGS. 14 and 15. The radially biased pawl 92 is pivotally secured to the threaded annular wall 48 about a longitudinal pivot axis, such as by a lever 96 pivotable about a longitudinal pivot pin 98 extending through a longitudinal bore 100 through the lever 96 and longitudinal bores 102 through the threaded annular wall 48. At one end of the lever 96, the radially biased pawl 92 extends through an opening or circumferential slot 104 through the retainer ring's threaded annular wall 48. The other or free end 106 of the lever 96 is outwardly biased in a generally radial direction by engagement with a spring 108 captured by a recess 110 in the retainer ring's threaded annular wall 48. The radially biased pawl 92 and the lever's free end 106 are situated on opposite sides of the longitudinal pivot pin 98, so that the bias of the spring 108 against the lever free end 106 causes the radially biased pawl 92 to be biased inwardly in a generally radial direction. A user may depress the lever's free end 106 against the bias of the spring 108 for causing the radially biased pawl 92 to be outwardly displaced in a generally radial direction.

Figure 18:
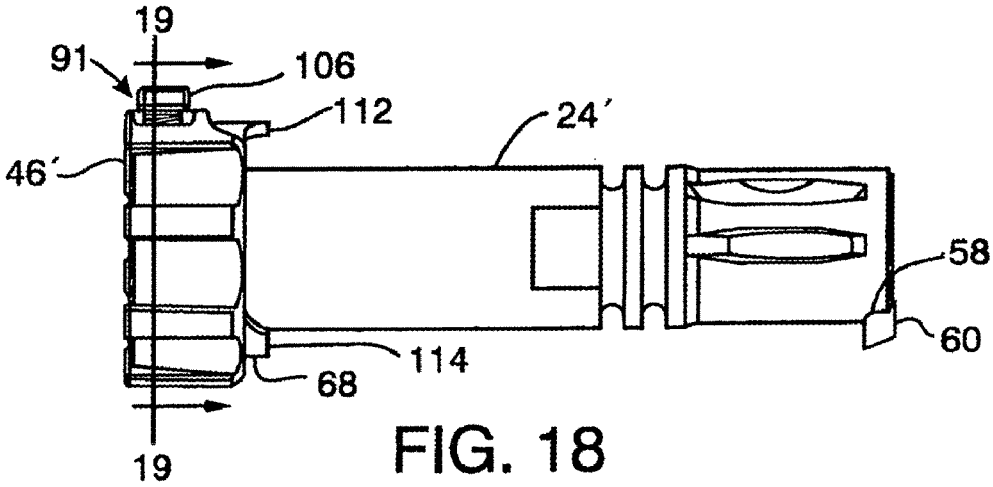
FIG. 18 is a side elevation view of the assembled retainer ring and flash suppressor components in the blocking and locking condition represented in FIG. 17, the noise suppressor not being shown in FIG. 18 for clarity of description.
Figure 19:
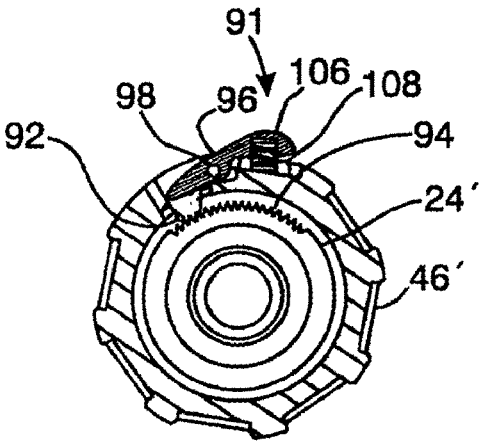
FIG. 19 is a cross sectional view of the apparatus of FIG. 18, taken along the line 19-19 of FIG. 18 and viewed in the direction of the appended arrows.
Figure 20:
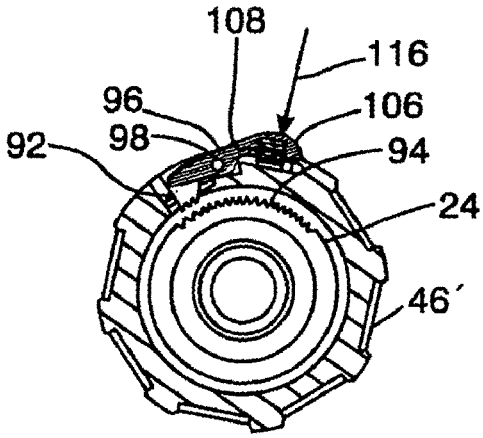
FIG. 20 is similar to FIG. 19, except that the assembled components are shown in the blocking but unlocked condition.

As shown in FIG. 13, the noise suppressor's back section 34 includes the previously described projecting stop pin 90, for cooperating with the retainer ring 46' for restricting rotation of the retainer ring 46' between its first and second rotational positions. This function may be implemented by equipping the retainer ring 46' with the longitudinally projecting segment 64 (FIG. 25) with first and second end surfaces 66, 68 previously described with respect to the first retainer ring embodiment 46. Alternatively, and as shown in FIGS. 13, 14 and 18, the forwardly facing edge of the threaded annular wall 48 of the example of the second preferred retainer ring embodiment 46' may include a first forward projection 112 and a second forward projection 114 having the respective first and second end surfaces 66 and 68 circumferentially spaced by an arc of say approximately 150°.

When installing the second preferred retainer ring embodiment 46' to the collar 42, a specimen of a second flash suppressor embodiment 24' may be inserted in the longitudinal bore 36 with the flash suppressor's forwardly facing notch 58 engaging the noise suppressor's radially disposed indexing pin 60. The retainer ring 46' is then threadedly rotated upon the threaded collar 42 (in the clockwise direction as viewed from the rear, i.e. from the left side of FIG. 13) until the first end surface 66 passes over the radial bore 88 in the collar 42 just before the radially biased pawl 92 engages the radial ratchet teeth 94. The projecting stop pin 90 is then fixedly secured into the radial bore 88, the projecting stop pin 90 radially projecting from the threaded outer surface 44. When the flash suppressor 24' specimen is removed, clockwise (threading) rotation of the retainer ring 46' is prevented when the ring's second end surface 68 contacts the projecting stop pin 90 (preferably while the retainer ring 46' is still in its second rotational position), and counterclockwise (unthreading) rotation of the retainer ring 46' is prevented when the ring's first end surface 66 contacts the projecting stop pin 90 (preferably at the ring's first rotational position). The projecting stop pin 90, situated between the ring's first and second end surfaces 66, 68 as described, causes the retainer ring 46' to be rotationally captive to the collar 42 between the ring's first rotational position (shown in FIG. 16) and the ring's second rotational position (shown in FIG. 17).

To install the noise suppressor (comprising the noise suppressor body 32 and the retainer ring 46') onto the firearm barrel 22, the noise suppressor body 32 with the retainer ring 46' installed to the collar 42 in the first rotational position as described above, is placed forwardly onto the barrel's muzzle end such that the flash suppressor 24' is longitudinally received by the back section longitudinal bore 36 through the circular opening 52, until the front edge 54 of the annular ridge 28 of the flash suppressor 24' engages the rear edge 56 of the collar 42 about the longitudinal bore 36, and with the annular external surface 55 toward the forward end portion of the flash suppressor 24' engaging the inner surface 57 of the noise suppressor back section 34. The front and rear edges 54, 56 may be configured with complementary bevels for implementing mating contact thereof. At the same time, the noise suppressor is rotationally adjusted with respect to the firearm barrel 22 for circumferentially indexing the noise suppressor body 32 with respect to the barrel and flash suppressor, and for preventing rotation of the noise suppressor body 32 with respect to the barrel and flash suppressor, for example by means of a longitudinal channel, such as the forwardly facing notch 58 at the front edge of the flash suppressor 24', receiving a radially disposed index pin 60 internally secured to the noise suppressor back section 34 (see FIGS. 13 and 18).

Figure 16:
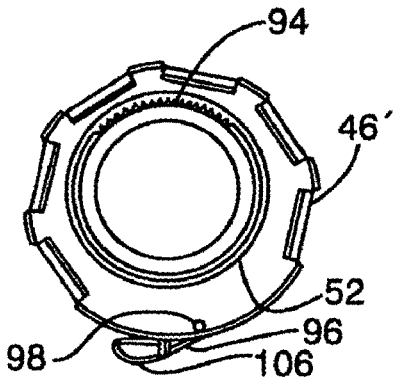
FIG. 16 is a rear view of the assembled components of FIG. 13 in an open condition permitting the noise suppressor to be installed to or be removed from the flash suppressor.
Figure 17:
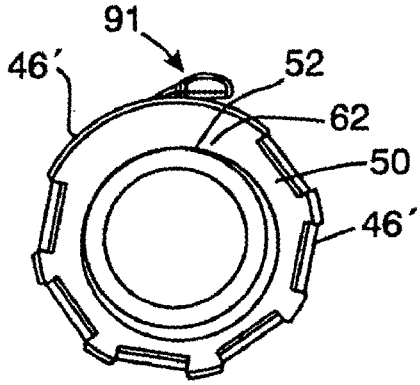
FIG. 17 is a view similar to FIG. 16, except that the apparatus is in a condition blocking removal of the noise suppressor from the flash suppressor and releasably locking the retainer ring in such blocked condition.

At this point during the installation, the circular opening 52 of the retainer ring 46', being concentric with the annular ridge 28 and having a diameter slightly greater than the diameter of the annular ridge 28, permits the retainer ring 46' to longitudinally pass over the flash suppressor's annular ridge 28 as shown in FIG. 16, with the radially biased pawl 92 situated just rearwardly of the circumferential surface of the flash suppressor annular ridge 28. After such passage, installation proceeds by threadedly rotating the retainer ring 46' upon the threaded outer surface 44 of the collar 42, with the resulting eccentric rotation of the circular opening 52 of the radial wall 50 to place a segment or portion 62 (see FIG. 17) of the radial wall 50 directly rearward of a portion of the annular ridge 28 of the flash suppressor 24'. At the same time, such threaded rotation causes the retainer ring 46' to forwardly translate such that the forward surface of the portion 62 of the radial wall 50 contacts that portion of the annular ridge 28 of the flash suppressor 24' while at the same time causes the radially biased pawl 92 to engage the radial ratchet teeth 94 on the flash suppressor 24'. Accordingly, the interfering portion 62 of the radial wall 50 blocks forward longitudinal passage of the retainer ring 46' over the annular ridge 28 of the flash suppressor 24', longitudinally clamping the noise suppressor body 32 to the flash suppressor 24', while the engagement of the radially biased pawl 92 carried by the retainer ring 46' with the radial ratchet teeth 94 on the flash suppressor 24' locks the retainer ring 46' against unthreading rotation, effectively locking the noise suppressor to the flash suppressor 24' and hence to the firearm barrel 22.

When it is desired to remove the noise suppressor from the flash suppressor 24' and the firearm barrel 22, the user depresses the free end 106 of the lever 96 (represented by the force arrow 116 in FIG. 20) against the bias of the free end 106, actuating the lever 96 to pivot about the longitudinal pivot pin 98 and thereby withdrawing the radially biased pawl 92 from its engagement with the radial ratchet teeth 94 on the flash suppressor 24'. The user simultaneously unthreads the retainer ring 46' until the retainer ring 46' is placed in its first or open position shown in FIG. 16. The user may thereupon longitudinally withdraw the noise suppressor (including the noise suppressor body 32 and the retainer ring 46') from the flash suppressor 24' and the firearm barrel 22.

The second locking device preferred embodiment (lever 96 carried by the retainer ring 46' and radial ratchet teeth 94 on the flash suppressor 24'), as well as the first locking device preferred embodiment (locking bar 72 carried by the noise suppressor body 32 and ratchet teeth 70 on the retainer ring 46), may be employed wherever a noise suppressor is longitudinally secured to a firearm's flash suppressor (or directly to the firearm's barrel) by a retainer ring or member threadably secured to the noise suppressor body, for locking the retainer member against unthreading rotation with respect to the noise suppressor body.

It has been previously noted that the annular ridge 28 may be included as a part of the exterior surface of a firearm barrel without the necessity of attaching a ridged flash suppressor to the barrel. Such an arrangement may be of particular advantage where, for example, the presence of a flash suppressor for securing a noise suppressor may adversely affect accuracy or consistency of firearm performance. This may be of particular importance as concerning high precision firearms, such as a Remington M24 sniper weapon, an example of which is represented as the firearm 118 in FIG. 21.

According to an aspect of the present invention, the muzzle end portion of the barrel 120 of the firearm 118 is modified for longitudinally securing a noise suppressor directly thereto by a retainer ring or member threadably secured to the noise suppressor body, and for locking the retainer member against unthreading rotation with respect to the noise suppressor body by a locking device such as the first or second locking device embodiments discussed above.

Figure 21:
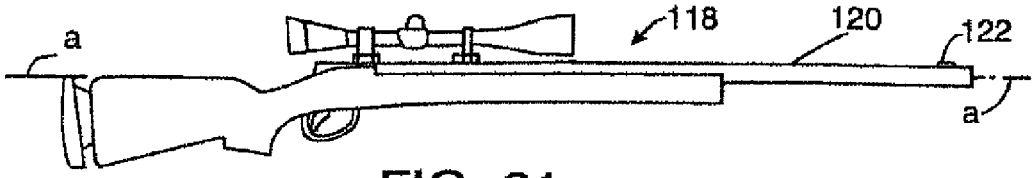
FIG. 21 is a side view of a firearm with barrel before being modified for securing the noise suppressor directly thereto.
Figure 22:
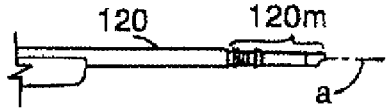
FIG. 22 is a fragment of the firearm barrel of FIG. 21 modified for securing the noise suppressor directly thereto.
Figure 23:
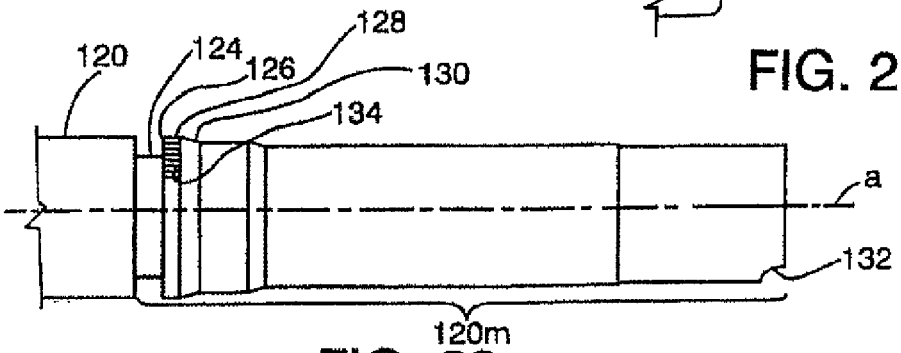
FIG. 23 is a side view of the muzzle end portion of the modified firearm barrel of FIG. 22, in enlarged scale, further including provision for locking the noise suppressor thereto in accordance with the present invention.

For example, the muzzle end portion of the barrel 120 of the firearm 118 of FIG. 21 may be modified as shown in FIG. 22 and in increased scale in FIG. 23. The front sight 122, which in the firearm represented is ordinarily mounted in a recess at the muzzle, is removed and, if desired, may be remounted rearwardly of a modified portion **120*m* of the barrel 120. In the preferred embodiment, the muzzle end portion of the barrel 120 is machined to produce the modified barrel portion 120*m***, by machining techniques well known in the art.

Figure 24:
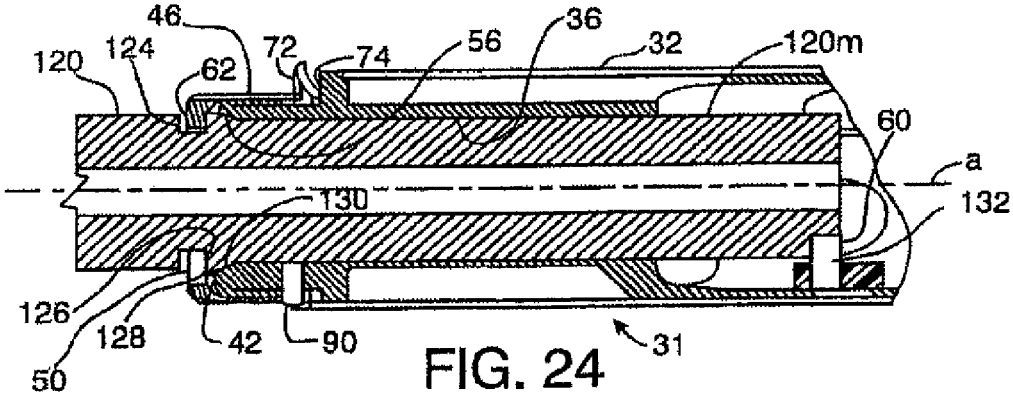
FIG. 24 is a longitudinal cross-sectional view of a fragment of the noise suppressor secured and locked to the modified firearm barrel shown in FIG. 23, utilizing the first preferred locking device embodiment.

In the preferred embodiment of the modified barrel portion **120*m*, an annular groove 124 is machined into the outer surface of the barrel 120, perpendicularly to the barrel's longitudinal axis a. The annular groove 124 includes a radial front wall 126 defining the rear surface of an annular ridge 128. The barrel is preferably further machined to provide the annular ridge 128 with a front edge 130 configured for engaging the rear edge 56 of the noise suppressor collar 42 when the modified barrel portion 120*m* is received by the noise suppressor longitudinal bore 36, as shown in FIG. 24**.

The radial depth and the longitudinal length of the annular groove 124 are of dimensions for accommodating the radial wall 50 of the retainer ring or member 46 or 46' so that the portion 62 of the retainer ring's radial wall 50 is permitted to contact a portion of the rear surface of the radial front wall 126 of the annular ridge 128 (i.e., the radial front wall 126 of the annular groove 124) upon installation of the noise suppressor 31 to the modified barrel portion **120*m***.

It may be appreciated that the preferred embodiment of the noise suppressor 31 interacts with the preferred embodiment of the modified barrel portion **120*m* in the same manner that the noise suppressor 31 interacts with the flash suppressor 24 or 24' as previously described. Specifically, to install the noise suppressor (comprising the noise suppressor body 32 and the retainer ring 46 or 46') onto the barrel 120, the noise suppressor body 32 with the retainer ring 46 or 46' secured to the threaded outer surface 44 in the first rotational position is placed rearwardly onto the barrel's muzzle end such that the modified barrel portion 120***m* is longitudinally received by the back section longitudinal bore 36 through the retainer ring circular opening 52, until the front edge 130 of the annular ridge 128 engages the rear edge 56 of the collar 42 about the longitudinal bore 36. At the same time, the noise suppressor is rotationally adjusted with respect to the barrel 120 for circumferentially indexing the noise suppressor body 32 to the barrel 120 and for preventing rotation of the noise suppressor body 32 with respect to the barrel, for example by means of a longitudinal channel, such as the forwardly facing notch 132 machined into the front edge of the modified barrel portion 120*m*, receiving the radially disposed indexing pin 60 internally secured to the noise suppressor back section 34, as shown in FIG. 24.

At this point during installation, the circular opening 52 of the retainer ring 46 or 46', being concentric with the annular ridge 128 and having a diameter slightly greater than the diameter of the annular ridge 128, permits the retainer ring 46 or 46' to longitudinally pass over the modified barrel portion's annular ridge 128, with the ring's radial wall 50 disposed in the annular groove 124. After such passage, installation proceeds by threadedly rotating the retainer ring 46 or 46' upon the threaded outer surface 44 of the collar 42, with the resulting eccentric rotation of the circular opening 52 of the radial wall 50 to place a segment or portion 62 of the radial wall 50 directly rearward of a portion of the annular ridge 128. At the same time, such threaded rotation causes the retainer ring 46 or 46' to forwardly translate such that the forward surface of the portion 62 of the radial wall 50 contacts that portion of the annular ridge 128 of the modified barrel portion 120*m*. Accordingly, the segment portion 62 of the radial wall 50 blocks forward longitudinal passage of the retainer ring 46 or 46' over the annular ridge 128 while longitudinally clamping the noise suppressor body 32 directly to the barrel 120.

As shown in FIG. 24, the previously described locking bar 72 is included on the noise suppressor body 32 for cooperating with the first retainer ring preferred embodiment 46 as previously described, for locking the retainer ring 46 against unthreading rotation.

Figure 25:
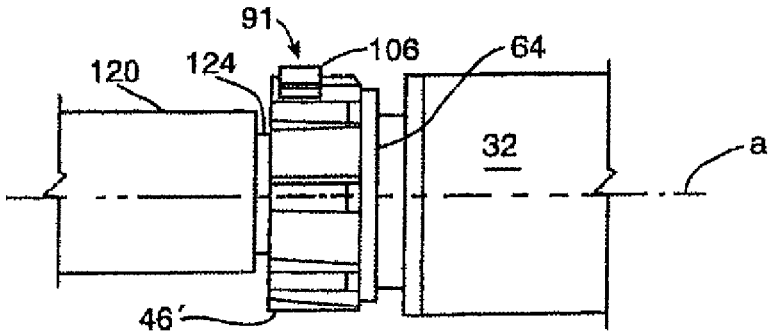
FIG. 25 is a fragmentary side view of the noise suppressor secured and locked to the modified barrel, utilizing the second preferred locking device embodiment.

FIG. 25 illustrates utilization of the second retainer ring preferred embodiment 46' which includes the locking lever mechanism 91 described above. In such case, the firearm modified barrel portion 120*m* is provided with a series of generally radial ratchet teeth 134 spaced along a circumference or a circumferential segment of the modified barrel portion 120*m*, preferably along the outer surface of the annular ridge 128 as shown in FIG. 23.

When it is desired to remove the noise suppressor with retainer ring 46 (with locking bar 72) from the firearm modified barrel portion 120*m*, the user unthreadedly rotates the retainer ring 46 while urging the radially extending pad 84 (see also FIG. 11) forwardly to release the pawl 82 from the ratchet teeth 70, analogously to such removal from the flash suppressor 24 as previously discussed. When removing the noise suppressor with retainer ring 46' (with locking lever mechanism 91) from the firearm barrel modified portion 120*m*, the user unthreadedly rotates the retainer ring 46' while depressing the free end 106 to release the radially biased pawl 92 from the ratchet teeth 134, analogously to such removal from the flash suppressor 24' as previously discussed. In either case, the user continues unthreadingly rotating the retainer ring 46 or 46' until the ring's first end surface 66 approaches or contacts the projecting stop pin 90, placing the retainer ring 46 or 46' in its first or open position respectively shown in FIGS. 12 and 16. The user thereupon longitudinally withdraws the noise suppressor 31 from the modified barrel portion 120*m*.

Thus, there have been described preferred embodiments of apparatus for easily, quickly and reliably attaching a noise suppressor or other auxiliary device to the muzzle end of a firearm, and for easily and quickly removing the device therefrom, as well as methods for such attachment. Other embodiments of the present invention, and variations of the embodiments described herein, may be developed without departing from the essential characteristics thereof. Accordingly, the invention should be limited only by the scope of the claims listed below.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

What is claimed is:

1. A method for attaching an auxiliary device to a firearm, the method comprising:

receiving an indexing feature of the auxiliary device directly at a corresponding indexing feature of a flash suppressor affixed to a muzzle end of a barrel of the firearm; and engaging a retaining mechanism of the auxiliary device with a retaining feature rearward of the corresponding indexing feature to prevent the auxiliary device from being removed from the barrel.

2. The method of claim 1, wherein the auxiliary device comprises:

a body comprising the indexing feature; and the retaining mechanism adapted to be rotated around the barrel between first and second positions relative to the body, wherein the retaining mechanism is adapted to enable the auxiliary device to be concentrically installed onto or removed from the barrel when disposed in the first position, and adapted to engage the retaining feature to prevent the auxiliary device from being removed from the barrel when disposed in the second position.

3. The method of claim 2, further comprising:

disposing the retaining mechanism in the first position;

installing the body concentrically over the muzzle end of the barrel such that the indexing feature engages with the corresponding indexing feature; and wherein the engaging the retaining mechanism comprises placing the retaining mechanism in the second position to secure the auxiliary device to the firearm.

4. The method of claim 2, further comprising engaging ratchet teeth with a locking mechanism of the auxiliary device to selectively lock the retaining mechanism in the first and second positions, wherein the ratchet teeth are on an external surface of the barrel.

5. The method of claim 1, further comprising:

removing a front sight from the barrel; and remounting the front sight on the barrel rearwardly of the retaining feature.

6. The method of claim 1, wherein the corresponding indexing feature comprises a longitudinal channel.

7. The method of claim 1, wherein the retaining feature is on an external surface of the barrel.

8. The method of claim 1, wherein the retaining feature is part of the auxiliary device.

9. The method of claim 1, wherein the auxiliary device is a noise suppressor.

10. The method of claim 1, wherein the firearm is a rifle.

11. The method of claim 1, wherein the indexing feature and the corresponding indexing feature are adapted to engage with each other to prevent rotation of a body of the auxiliary device with respect to the barrel.

12. The method of claim 1, wherein the indexing feature and the corresponding indexing feature are adapted to engage with each other to index a body of the auxiliary device with respect to the barrel.

13. An auxiliary device for attachment to a firearm, the auxiliary device comprising:

a body comprising an indexing feature adapted to directly engage with a corresponding indexing feature of a flash suppressor affixed to a muzzle end of a barrel of the firearm when the auxiliary device is attached to the firearm; and a retaining mechanism adapted to selectively engage a retaining feature rearward of the corresponding indexing feature to prevent the auxiliary device from being removed from the barrel.

14. The auxiliary device of claim 13, wherein the retaining mechanism is adapted to be rotated around the barrel between first and second positions relative to the body, wherein the retaining mechanism is adapted to enable the auxiliary device to be concentrically installed onto or removed from the barrel when disposed in the first position, and adapted to engage the retaining feature to prevent the auxiliary device from being removed from the barrel when disposed in the second position.

15. The auxiliary device of claim 14, further comprising a locking mechanism adapted to selectively lock the retaining mechanism in the first and second positions.

16. The auxiliary device of claim 15, wherein the locking mechanism is adapted to engage ratchet teeth on an external surface of the barrel.

17. The auxiliary device of claim 15, wherein the locking mechanism comprises:

ratchet teeth disposed on a front face of the retaining mechanism, wherein the retaining mechanism is rotatably coupled to a rear end of the body; and a pawl disposed on a rear face of the body in opposition to the ratchet teeth and adapted to be releasably biased into engagement with the ratchet teeth.

18. The auxiliary device of claim 15, wherein the locking mechanism comprises:

ratchet teeth disposed on a circumferential surface of a rear end of the body; and a pawl pivotally disposed in a recess in a circumferential surface of the retaining mechanism and in opposition to the ratchet teeth, wherein the pawl is adapted to be releasably biased into engagement with the ratchet teeth, wherein the retaining mechanism is rotatably coupled to a rear end of the body.

19. The auxiliary device of claim 13, wherein the corresponding indexing feature comprises a longitudinal channel.

20. The auxiliary device of claim 13, wherein the retaining feature is on an external surface of the barrel.

21. The auxiliary device of claim 13, wherein the retaining feature is part of the auxiliary device.

22. The auxiliary device of claim 13, wherein the auxiliary device is a noise suppressor.

23. The auxiliary device of claim 13, wherein the firearm is a rifle.

24. The auxiliary device of claim 13, wherein the indexing feature and the corresponding indexing feature are adapted to engage with each other to prevent rotation of the body with respect to the barrel.

25. The auxiliary device of claim 13, wherein the indexing feature and the corresponding indexing feature are adapted to engage with each other to index the body with respect to the barrel.

26. A method for attaching an auxiliary device to a firearm, the method comprising:

receiving an indexing feature of the auxiliary device directly at a corresponding indexing feature of a muzzle end of a barrel of the firearm; and engaging a retaining mechanism of the auxiliary device with a retaining feature rearward of the corresponding indexing feature to prevent the auxiliary device from being removed from the barrel.

27. An auxiliary device for attachment to a firearm, the auxiliary device comprising:

a body comprising an indexing feature adapted to directly engage with a corresponding indexing feature of a muzzle end of a barrel of the firearm when the auxiliary device is attached to the firearm; and a retaining mechanism adapted to selectively engage a retaining feature rearward of the corresponding indexing feature to prevent the auxiliary device from being removed from the barrel.

* * * * *